United States Patent [19]

Klaus et al.

[11] 4,252,261

[45] Feb. 24, 1981

[54] PNEUMATIC FASTENER DRIVING TOOL

[75] Inventors: Arthur Klaus, Frankfurt am Main; Hans Wilhelm, Bad Vilbel, both of Fed. Rep. of Germany

[73] Assignee: Signode Corporation, Glenview, Ill.

[21] Appl. No.: 42,768

[22] Filed: May 29, 1979

[30] Foreign Application Priority Data

Jul. 14, 1978 [DE] Fed. Rep. of Germany ..... 2831055

[51] Int. Cl.[3] ..... B25C 1/00

[52] U.S. Cl. ..... 227/130; 91/402; 91/417 A

[58] Field of Search ..... 227/130; 91/6, 402, 91/417 A, 461

[56] References Cited

U.S. PATENT DOCUMENTS

| | | | |
|---|---|---|---|
| 3,374,934 | 3/1968 | Dickson | 227/130 |
| 3,406,889 | 10/1968 | Cast | 227/130 |
| 3,776,444 | 12/1973 | Kuehn et al. | 227/130 |

FOREIGN PATENT DOCUMENTS

| | | | |
|---|---|---|---|
| 2529873 | 1/1977 | Fed. Rep. of Germany | 227/130 |

*Primary Examiner*—John McQuade

*Attorney, Agent, or Firm*—Dressler, Goldsmith, Shore, Sutker & Milnamow, Ltd.

[57] ABSTRACT

A pneumatic driving system for causing a nail or the like to run out of the barrel of a nailing tool to where its point may be seen by the user for lining up with a hole on the work and subsequently driving the nail into the workpiece.

6 Claims, 7 Drawing Figures

PNEUMATIC FASTENER DRIVING TOOL

The invention has to do with a compressed air nail driving tool including a cylinder, an axially moving working piston in said cylinder, and containing at its lower end a driving pin, a nail output barrel in which the driving pin is guided, a fastening element magazine, a main control valve placed at the upper end of the cylinder, a compressed air storage space separated from the working space of the cylinder by the main control valve, a lid shutting off the cylinder, and a valve mechanism for providing partial movement of the driving piston to move the nail partially out of the barrel to expose the nail point.

Generally used air-powered driving tools are worked with a pressure of 6 to 8 bar. Control valves let the compressed air into a cylinder space, the working piston, which has a driving pin fixed to its bottom, being moved axially for driving a fastening element, as, for example, a nail, a staple, or the like, out of the driving barrel into the workpiece.

Because in a working operation the fastening element, more specifically a nail, is placed for all its length in the driving barrel, it is hard for the position of the nail used for nailing to be fixed, because no part of the nail is exposed and only the barrel is seen.

In the case of workpieces, which are made stronger with, for example, sheet metal, or are fixed to pieces of sheet metal, which is less than 2 mm thick, the nail may be forced through the sheet metal without holes being made beforehand in the sheet metal. If the sheet metal is more than 2 mm thick, the striking force of the working piston is not enough to force the nail through the sheet metal into the workpiece. For this reason, holes are made in the sheet metal through which the nail is pushed into the workpiece. In order to make certain of the right position of the nail the driving tools have a fitting with the purpose of pushing the nail partly out of the barrel. Because of this, the nail may be placed at the right point of the workpiece for the fastening operation (for example, in holes in the case of sheet metal parts with holes in them) and then the nail may be pushed home.

Fittings have been designed earlier which take the form of a compressed air cylinder placed on the lid or top end of the driving tool, and whose piston rod, when getting an impulse, is responsible for moving the working piston and so moving the nail for some distance out of the barrel. However, such fittings are not readily usable with portable hand driving tools, because they make for an undesired increase in design size.

The purpose of the present invention is that of designing a fitting for air-powered nail run out, which does not make for any important increase in the design size and weight of a portable hand driving tool.

For effecting this purpose of the invention, an air control system makes for a limited axial forward motion of the working piston, so that the fastening element is moved for a certain distance out of the barrel.

The control system is more specially made up of a control piston that is spaced concentrically in the lid. It has an axial hole, which in the working position of the control piston is joined with a compressed air source.

The control piston has more specially on its end face a sealing ring placed around the opening of the hole that is used for shutting the outlet air opening placed in the main control valve, when the control piston is in the working position. Because of this measure, the working space of the cylinder is joined with the compressed air store in the working position of the control piston.

In the overrun hole, there is more specially a check valve, which by means of a tilting lever may be worked at the same time as the control piston in the opening direction. When the working piston, after working of the tilting lever, has been moved as far as the overrun hole, the compressed air is able to be let out of the working space of the piston through the overrun hole and the working piston is stopped.

The compressed air needed for the air-powered run out control is more specially taken straightway from the driving tool. For this purpose, in the case of a form of the invention of specially good effect, the hole in the control piston is in line, in the working position of the control piston with an inlet duct placed in the lid that is placed opening into the compressed air storage space.

In this respect, more specially, there is an adjustment choke placed in the inlet duct for adjustment of the run out speed of the working piston.

In the drawings, there is a view of a preferred form of the compressed air driving tool with a fitting for air-powered nail run out using the invention, of which an account will now be given.

Figure 1:
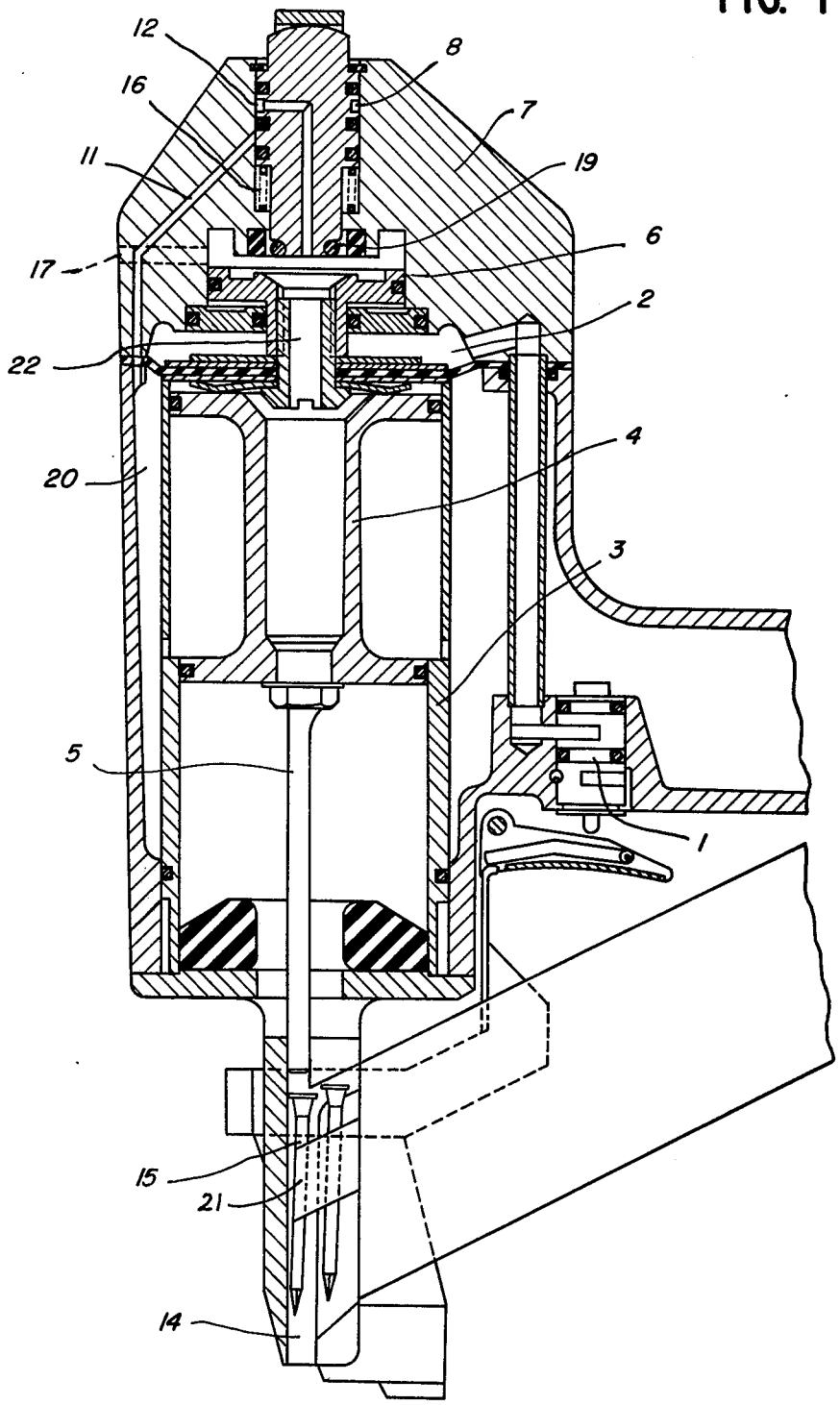
FIG. 1 is a long-section through an air-powered nailing tool with a fitting for pneumatic nail run out in the starting position.

FIG. 1 has a view of a compressed air nailing tool of normal design. This nailing tool has an operation valve 1, a main control valve 2 and a cylinder 3, in which a working piston 4, in the form of a differential piston, is placed for axial motion. A driving pin 5 is fixed to the bottom of the piston.

Figure 2:
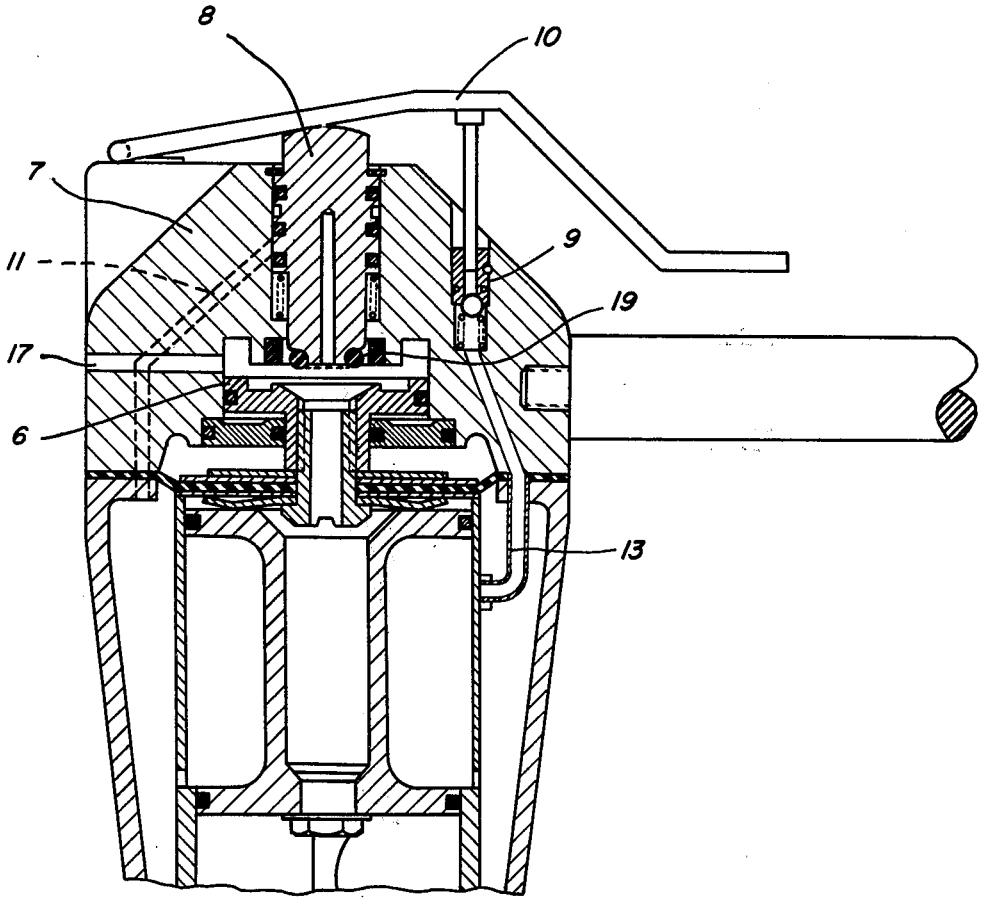
FIG. 2 is a part-view, turned through 90° in relation to FIG. 1, of the fitting in the starting position.

The main control valve 2 has a pilot piston 6, which has an axial air let-off opening 22 in it. A lid 7 is fixed over the main control valve 2. In the lid 7 the fitting for air-powered nail run out is placed and it is made up of a control piston 8 able to be moved coaxially in relation to the working piston, and a ball check valve 9 (see FIG. 2) which are both able to be worked by a mechanical tilting lever 10. A screw (helical) spring 16 is placed resting against the lid 7 and the control valve 8 for forcing the valve 8 upwards into its resting position. The control valve 8 has a sealing ring 19 on its lower end face. The ball check valve 9, opening into the outside air, is joined through an overrun duct 13 with the working space of the cylinder 3. In the lid 7 there is an inlet duct 11 opening into the compressed air storage space 20. The control piston 8 has a hole 12, which is made up of a lower axial part and a top radial part. The radial part of the hole 12 may be put into line with the inlet duct 11 formed in the lid 7. The space between the pilot piston 6 and the control piston 8 is joined by means of outlet openings 17, formed in the lid 7, with the outside air.

Figure 3:
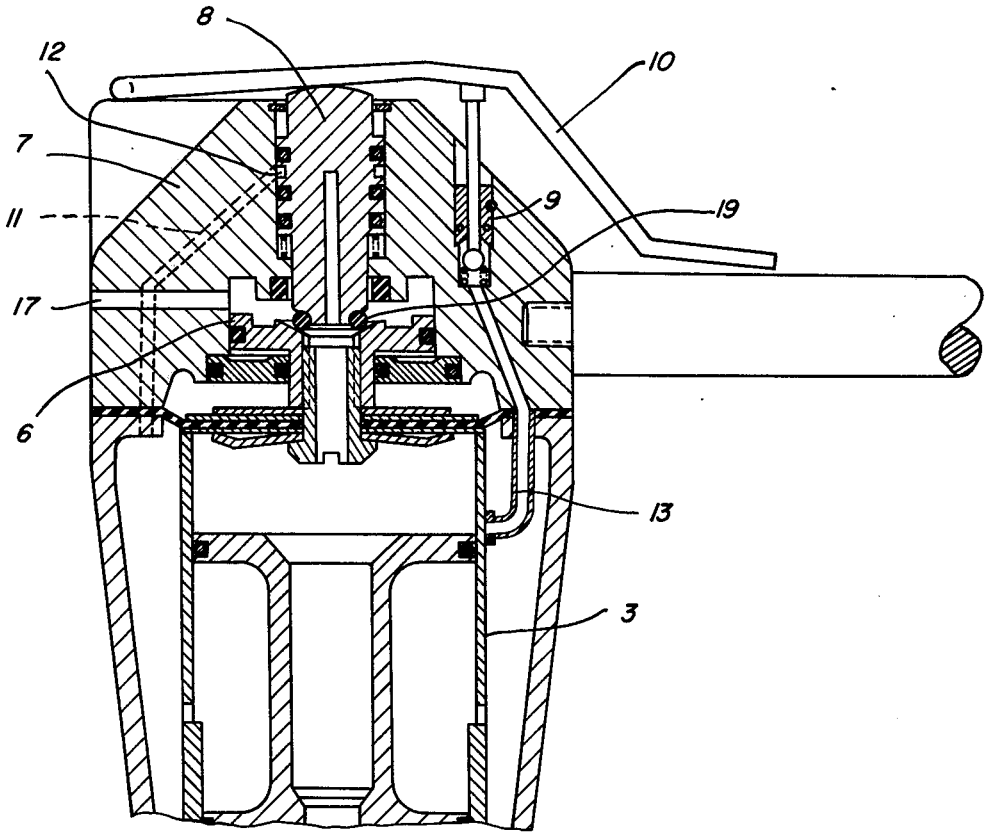
FIG. 3 is a part-view like FIG. 2 with the fitting in the working position with the working piston moved forwards.
Figure 4:
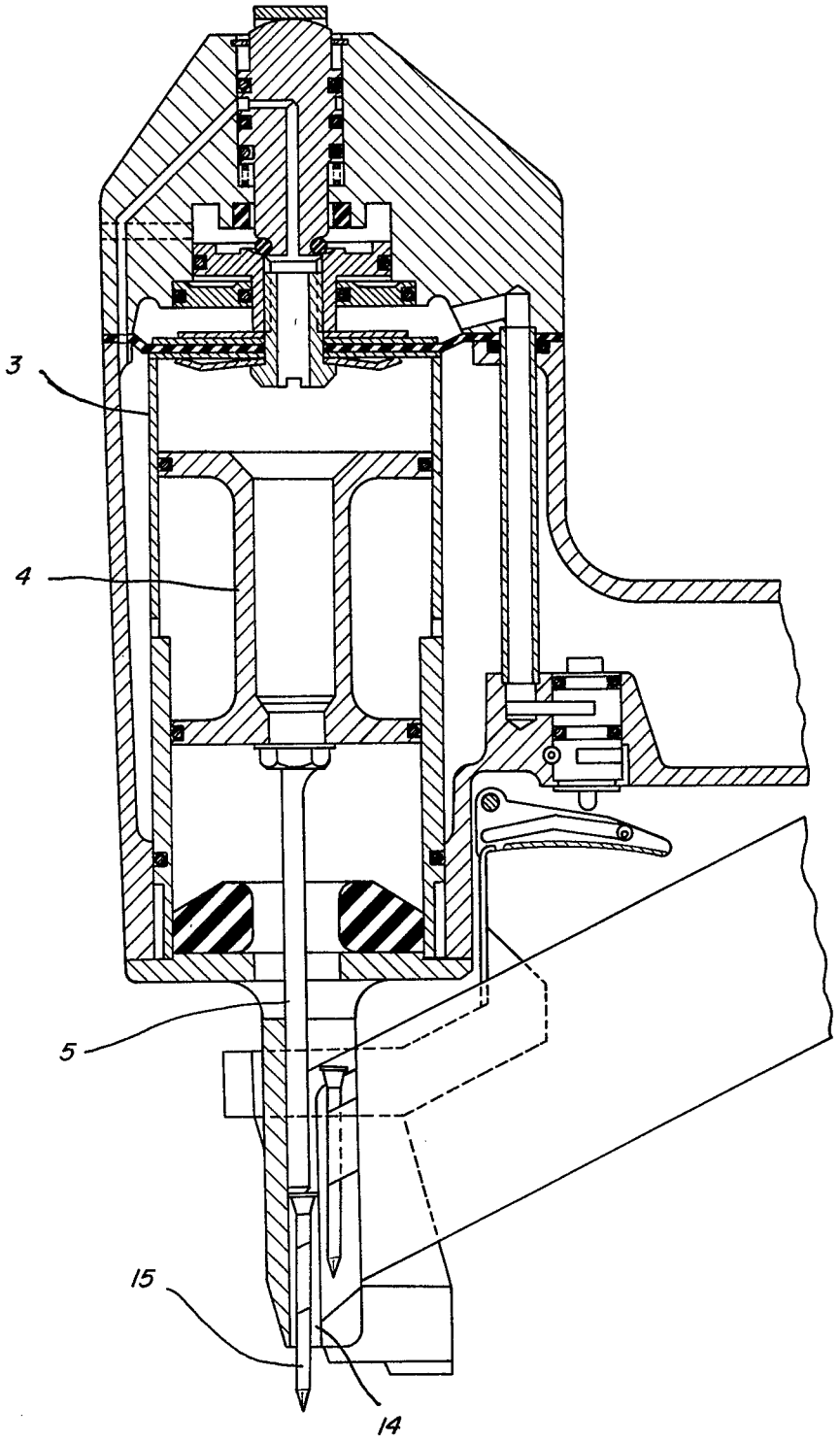
FIG. 4 is a long-section through the nailing tool of FIG. 1, whose fitting has been worked, with the working piston moved forwards and with the nail point run out.
Figure 5:
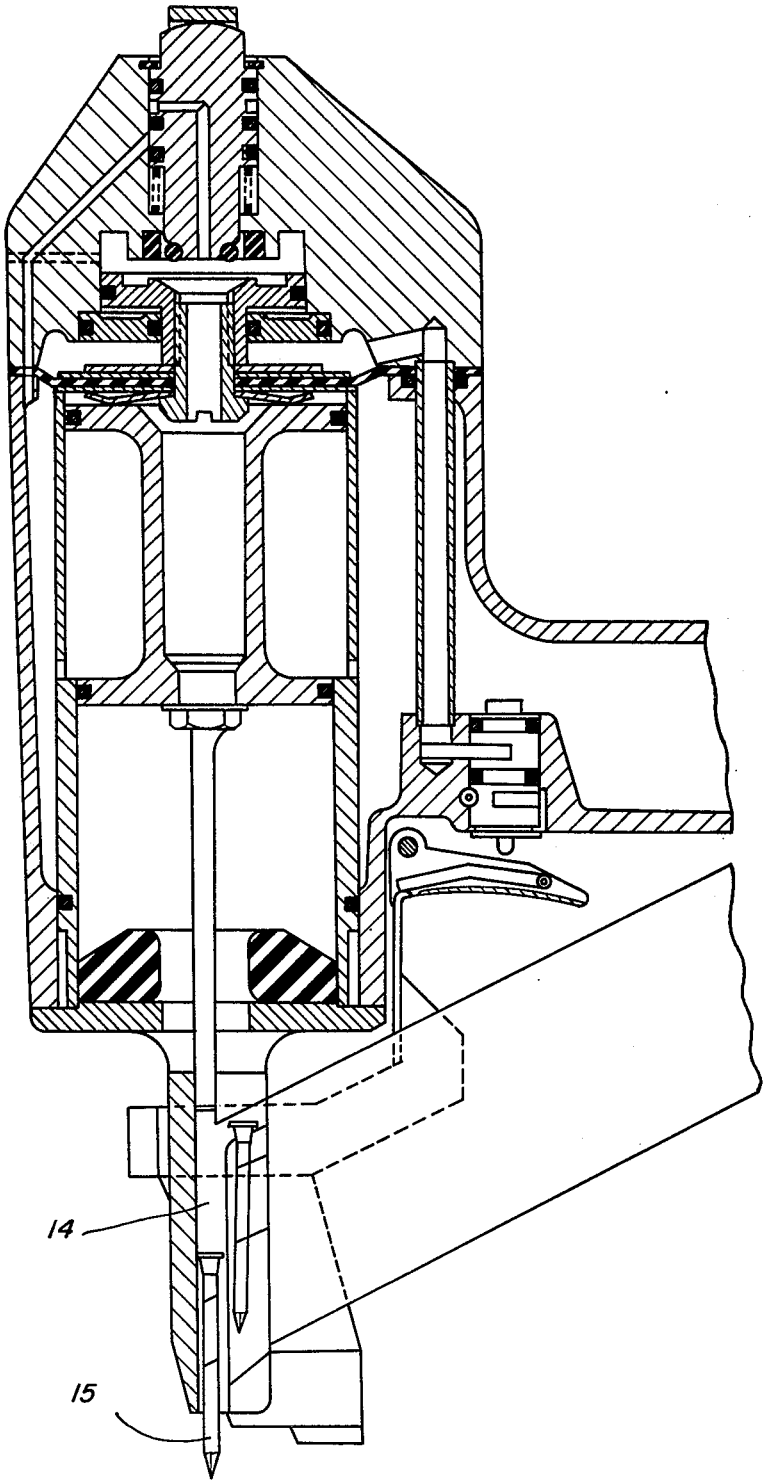
FIG. 5 is a long-section through the nailing tool of FIG. 1 after working the fitting with the run out nail point, the working piston being back in its starting position before the start of the driving operation.
Figure 6:
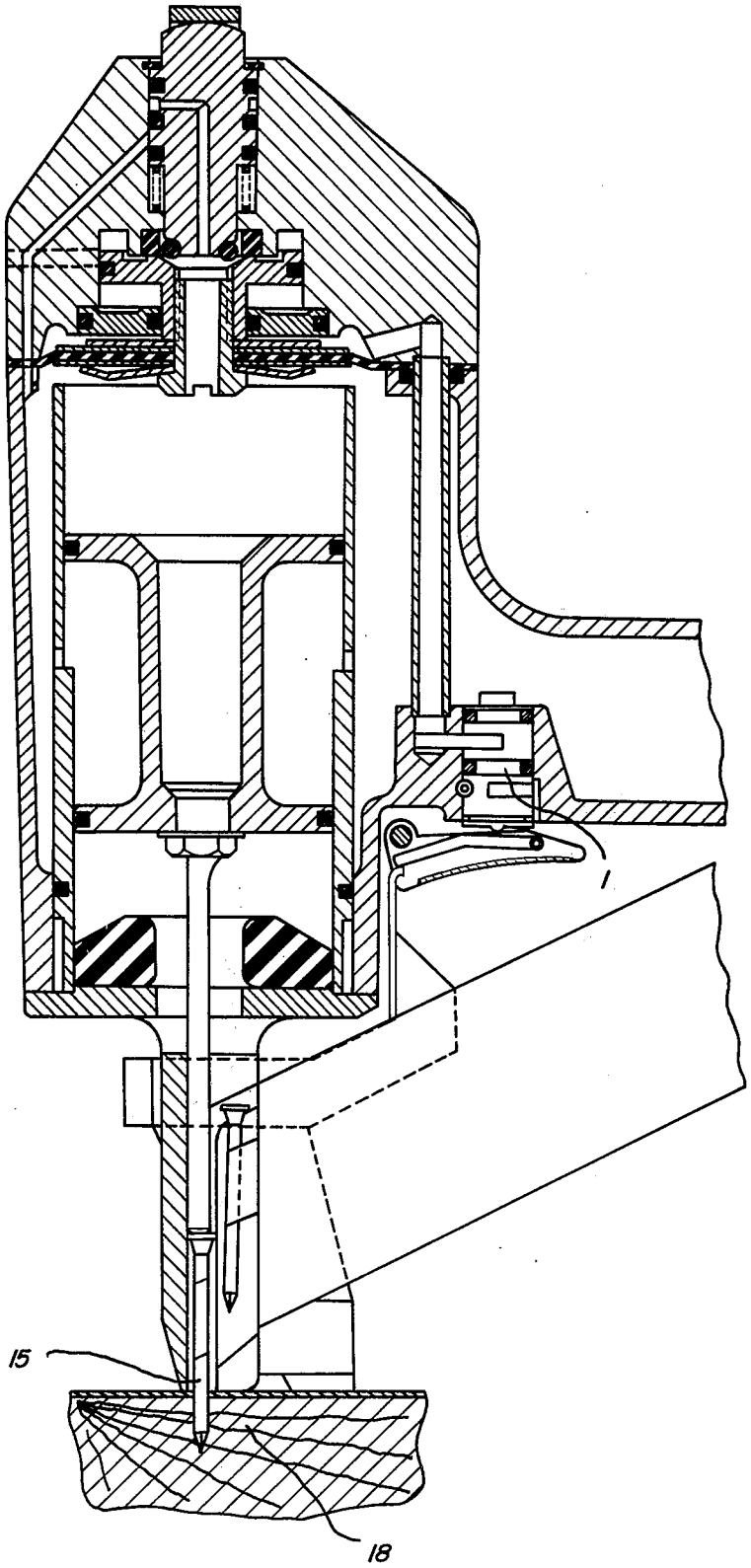
FIG. 6 is a long-section through the nailing tool of FIG. 1 when the driving operation is taking place.
Figure 7:
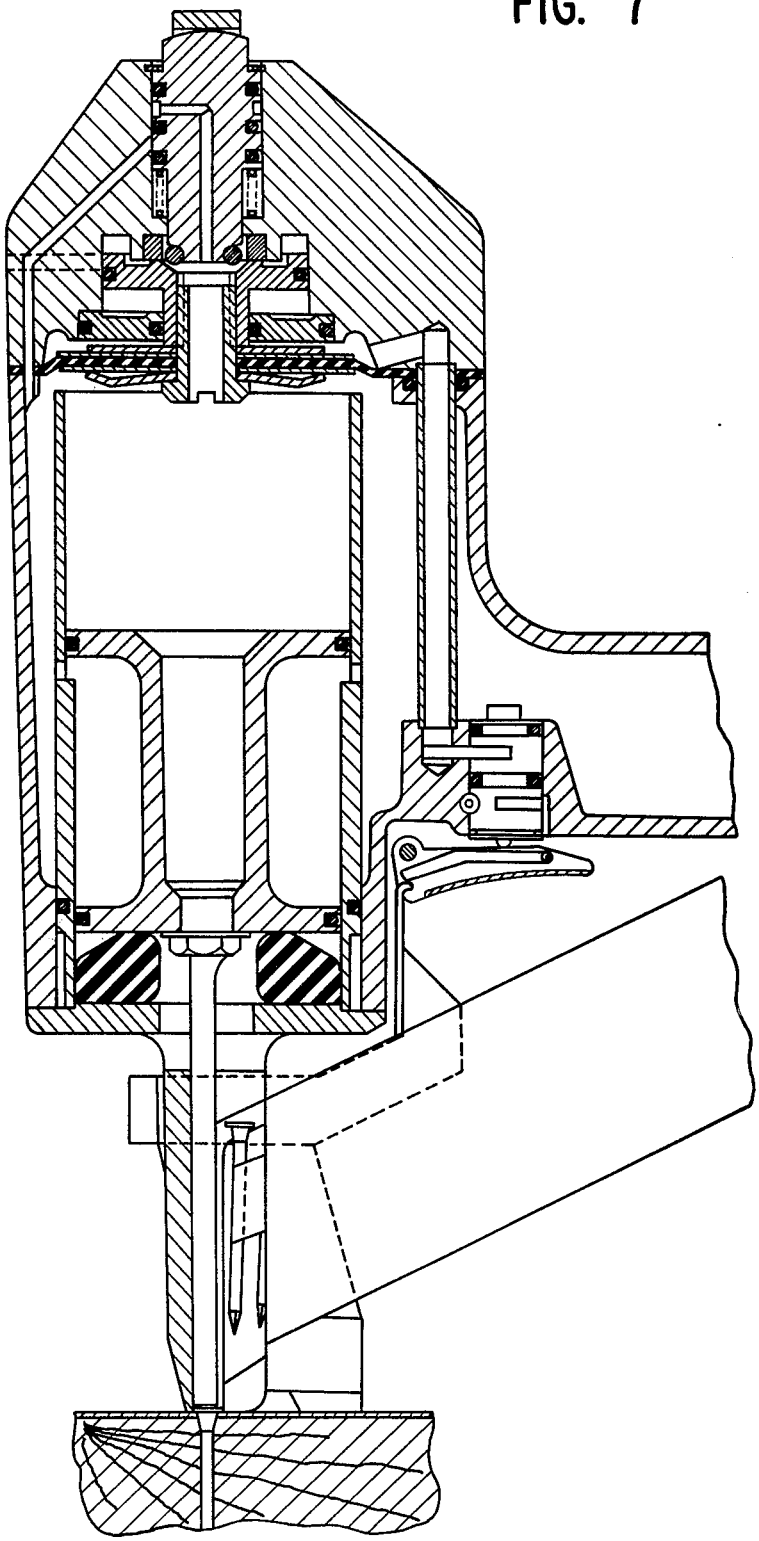
FIG. 7 is a long-section through the nailing tool of FIG. 1 after the end of the driving operation and shortly before the back motion of the piston.

The driving pin 5, fixed to the working piston 4, is guided in a nail driving barrel 14 for driving in a nail 15, which comes in from a nail magazine 21 of regular design. An account will now be given of the operation of the fitting for air-powered nail run out in a nailing tool:

By pushing down the tilting lever 10 (FIG. 3), the control piston 8 is moved axially, so that it makes a seal with the sealing ring 19 at the air outlet opening 22 of the pilot piston 6 of the main control valve 2. At the same time the ball check valve 9 is opened, which is joined with the working space of the cylinder 3 through the overrun duct 13. Through the inlet duct 11 and the hole 12 in the control piston 8, compressed air goes from the compressed air storage space 20 between the main control valve 2 and the working piston 4. This compressed air has the effect of moving the working piston 4 with the driving pin 5 and the nail 15 in the barrel 14 downwards, so that the working piston 4 is positioned to interconnect the overrun duct 13 with the ball check valve 9 (FIG. 3). When this happens, the point of the nail 15 is pushed out of the barrel 14. Once the working piston 4 has come into the position of FIGS. 3 and 4, the pressure in the working space of the cylinder 3 between the the main control valve 2 and the working piston 4 is decreased through the opening ball check valve 9 and the working piston 4 is stopped. When the tilting lever 10 is unloaded the spring 16 will be pushing the control piston 8 upwards into its starting position, while at the same time the ball check valve 9 will be shut. Through the outlet openings 17 the compressed air, which is in the working space of the cylinder 3 between the working piston 4 and the main control valve 2, is let off and the working piston 4 is pushed back into its starting position (see FIGS. 2 and 5) because it is designed as a differential piston. Because of the run out of the point of the nail 15, that is to say, because the nail point is sticking out of the barrel, the driving tool may be pointed exactly at any point of the workpiece 18 at which fastening is to take place. By working the operation valve 1, the driving home operation is then started in the normal way (see FIGS. 6 and 7). In the inlet duct 11, there is an adjustment choke (not shown in the drawing) by which the speed of forward movement of the working piston may be smoothly changed to different values.

It is, of course, intended to cover by the appended claims all such modifications that come within the true spirit and scope of the invention.

What is claimed is:

1. A pneumatic fastener driving tool for driving a fastener element into a workpiece comprising a housing defining a high-pressure air storage chamber, a cylinder, an axially movable working piston means in said cylinder movable between a driving and a driven position, means for normally maintaining the working piston means in its driving position, a driving pin secured to said working piston means, a guide means for said driving pin, a fastener element magazine secured to said housing and positioned to direct a fastener element into said guide means below said driving pin, a main control valve means for regulating the flow of high-pressure air into said cylinder to drive said working piston means, secondary control valve means and means for actuating same for (1) regulating the flow of high-pressure air into said cylinder above said working piston means, (2) exhausting said cylinder above the working piston means after the working piston means is moved a predetermined amount, whereby upon actuation of said secondary control valve means the working piston means will be moved a predetermined amount to move the driving pin into engagement with said fastener element to move a portion of said fastener element out of said guide means, so that the positioning of the fastener element relative to such tool can be observed to facilitate orientation for the fastener element to the workpiece, and means for controlling operation of said control valve means to operate said working piston means to move a fastener element into a workpiece.

2. A pneumatic fastener driving tool as set forth in claim 1 in which the secondary control valve means includes a first valve means for controlling the flow of air from said high-pressure storage chamber into the cylinder above said working piston means and a second valve means controlling the exhaust of high-pressure air from said cylinder above the piston means after the working piston means has been moved a predetermined amount.

3. A pneumatic fastener driving tool as set forth in claim 2 in which the means for actuating said secondary control valve means includes a lever means for moving said first valve means to interconnect said high-pressure storage chamber and said cylinder above the piston means and to open said second valve means to atmosphere to vent the cylinder above the piston means after the piston means moves a predetermined amount to eject a fastener element a short distance beyond the end of the housing.

4. A pneumatic fastener driving tool as set forth in claim 3 in which the main control valve means defines a port interconnecting said cylinder with the atmosphere and said first valve means moves into and out of sealing engagement with said port to close said port and introduce high-pressure air from said storage chamber into said cylinder above said piston means and when moved out of engagement with said port to vent the air from above the piston means to permit it to be moved to a driving position.

5. A pneumatic fastener driving tool in accordance with claim 4 in which the first valve means comprises a slidable plunger disposed in a cap portion of said housing, said plunger and housing defining interconnecting conduit means to direct compressed air from said storage chamber to said cylinder above said piston means when said plunger is placed in sealing engagement with said port when said lever means engages the upper portion of said slidable plunger to effect the abbreviated movement of said piston means to eject the fastener element a short distance beyond the end of the housing.

6. A pneumatic fastener driving tool as set forth in claim 1 in which the means for normally maintaining the working piston means in its driving position includes means for exhausting the cylinder above the working piston means to permit the piston to return to its driving position to permit subsequent driving of said fastener element into the work piece.

* * * * *